US012152785B2

(12) United States Patent
Lee et al.

(10) Patent No.: US 12,152,785 B2
(45) Date of Patent: Nov. 26, 2024

(54) OVEN AND METHOD FOR CONTROLLING THE SAME

(71) Applicant: LG Electronics Inc., Seoul (KR)

(72) Inventors: Namil Lee, Seoul (KR); Seung Jun Lee, Seoul (KR); Jongsoo Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 384 days.

(21) Appl. No.: 17/588,741

(22) Filed: Jan. 31, 2022

(65) Prior Publication Data

US 2022/0243926 A1 Aug. 4, 2022

(30) Foreign Application Priority Data

Feb. 3, 2021 (KR) ..... 10-2021-0015708

(51) Int. Cl.

| | |
|---|---|
| ***F24C 7/00*** | (2006.01) |
| ***F24C 7/02*** | (2006.01) |
| ***F24C 7/08*** | (2006.01) |
| ***F24C 15/32*** | (2006.01) |

(52) U.S. Cl.

CPC ..... *F24C 15/325* (2013.01); *F24C 7/02* (2013.01); *F24C 7/085* (2013.01)

(58) Field of Classification Search

CPC .. F24C 7/08; F24C 7/085; F24C 7/087; F24C 15/322; F24C 15/325; F24C 3/12; F24C 3/128; H05B 6/06; H05B 6/645; H05B 6/68; H05B 6/6473; H05B 6/6485

USPC ..... 219/681; 126/21 A

See application file for complete search history.

(56) References Cited

U.S. PATENT DOCUMENTS

| | | | | |
|---|---|---|---|---|
| 10,721,948 | B1 | 7/2020 | Swayne et al. | |
| 2018/0064280 | A1* | 3/2018 | Junkmann | A47J 27/002 |
| 2020/0281391 | A1 | 9/2020 | Swayne et al. | |
| 2022/0243926 | A1* | 8/2022 | Lee | F24C 15/325 |
| 2022/0322711 | A1* | 10/2022 | Horstmann | F24C 15/322 |

FOREIGN PATENT DOCUMENTS

| | | | |
|---|---|---|---|
| CN | 105996805 | 10/2016 | |
| EP | 2282128 | 2/2011 | |
| GB | 1455838 | 11/1976 | |
| GB | 2065867 | 7/1981 | |
| GB | 2172990 | 10/1986 | |
| WO | WO-2021069248 A1 * | 4/2021 | A23L 5/11 |

OTHER PUBLICATIONS

Extended European Search Report in European Appln. No. 22152946.4, dated Jun. 21, 2022, 8 pages.

* cited by examiner

*Primary Examiner* — Ko-Wei Lin
(74) *Attorney, Agent, or Firm* — Fish & Richardson P.C.

(57) ABSTRACT

The present disclosure relates to an oven and a method for controlling thereof. When performing an air sous vide mode, a convection heater is controlled to turn-on and turn-off in a certain duration of the entire cooking operation based on a hysteresis algorithm. Specifically, a heat stage of the oven includes a first heat stage and a second heat stage, and in each cycle of the second heat stage, the oven may control the turn-on and turn-off of the convection heater based on the hysteresis algorithm from a first time point that arrives after the start time of each cycle. Accordingly, the cooking ingredient may be quickly heated in a sous vide method while temperature deviation of a cooking chamber is reduced.

20 Claims, 8 Drawing Sheets

OVEN AND METHOD FOR CONTROLLING THE SAME

CROSS-REFERENCE TO RELATED APPLICATION

This application claims priority to and the benefit of Korean Patent Application No. 10-2021-0015708, filed on Feb. 3, 2021, the disclosure of which is incorporated herein by reference in its entirety.

TECHNICAL FIELD

The present disclosure relates to an oven performing an operation for realizing air sous vide and a method for controlling the same.

BACKGROUND

An oven is a home appliance that heats and a cooking ingredient put in a cooking chamber formed inside a case. The oven includes at least one heating source for heating the cooking ingredient. Based on the heating method, the heating source may be divided into a high frequency heating source, a radiant heating source, a convection heating source and the like. The operation of the heating source may be controlled based on the type of the cooking ingredient, substantially the recipe.

Meanwhile, sous vide is a cooking method in which the cooking ingredient is placed in a sealed bag and slowly heated with water at an accurately calculated temperature. When cooking ingredient is cooked according to the sours vide method, moisture is maintained and taste, aroma and juiciness area preserved, and the texture becomes soft.

Recently, the study of applying the sous vide method using air to the oven is being conducted.

FIG. 1 is a diagram to describe a prior art applying the sous vide method to the conventional oven.

FIG. 1 corresponds to FIG. 3 of the prior art (U.S. Pat. No. 10,721,948) and the reference numerals shown in FIG. 1 are limited only to components of FIG. 1.

Referring to FIG. 1, a cooking appliance 100 according to the prior art performs air sous-vide style cooking and supplies heat by driving a convection heating element 104. Here, the convection heating element 104 may be controlled using a Proportional-Integral-Derivative (PID) algorithm.

Especially, the conventional air sous-vide cooking method according to FIG. 1 may perform a driving process in four steps. A target temperature disclosed in steps S1 and S1 is set to be lower than a set temperature. A target temperature in a step S3 is set to be higher than the set temperature and a target temperature in a step S4 is set to be substantially equal to the set temperature. The step S1 is performed until the target temperature is achieved and the step S2 is performed for five minutes. The step S3 is performed for ten minutes and the step S4 is performed until cooking is completed.

However, in the prior art, the cooking chamber is heated to the final target temperature through three preceding steps S1, S2 and S3. In this case, there is a disadvantage in that the duration time of the three preceding steps S1, S2 and S3 is quite long.

Meanwhile, the prior art discloses a concept of heating the cooking ingredient using a hysteresis algorithm. However, the prior art fails to disclose a specific control method of the hysteresis algorithm.

SUMMARY

One object of the present disclosure is to provide an oven and a method for controlling thereof that may heat a cooking ingredient in an air sous vide method.

Another object of the present disclosure is to provide an oven and a method for controlling thereof that may heat a cooking ingredient quickly with reducing temperature variations in a cooking chamber when implementing air sous vide.

A further object of the present disclosure is to provide an oven and a method for controlling thereof that may prevent excessive repetition of turning on/off of a convection heater when maintaining the temperature of the cooking chamber.

Aspects according to the present disclosure are not limited to the above ones, and other aspects and advantages that are not mentioned above can be clearly understood from the following description and can be more clearly understood from the embodiments set forth herein.

In an oven and a method for controlling thereof of one embodiment, when performing an air sous vide mode, a convection heater is controlled to turn-on and turn-off in a certain duration of the entire cooking operation based on a hysteresis algorithm.

Specifically, a heat stage of the oven includes a first heat stage and a second heat stage, and in each cycle of the second heat stage, the oven may control the turn-on and turn-off of the convection heater based on the hysteresis algorithm from a first time point that arrives after the start time of each cycle. Accordingly, the cooking ingredient may be quickly heated in a sous vide method while temperature deviation of a cooking chamber is reduced.

In an oven and a method for controlling thereof of one embodiment, the turning on/off of the convection heater may be controlled using a hysteresis algorithm, thereby, when the temperature of the cooking chamber is maintained, it is possible to prevent excessive repetition of turning on/off of the convection heater In an oven and a method for controlling thereof of one embodiment, when performing the air sous vide mode, the oven may heat the cooking ingredient under optimal conditions by controlling the driving time of the convection heater.

An oven for performing a heat stage for implementing air sous vide in one embodiment may include that performs an operation for implementing air sous vide including a case in which a cooking chamber is formed, a sensor configured to sense a temperature of the cooking chamber, a convection module comprising a convection heater configured to heat air and a convection fan configured to supply the air heated by the convection heater into the cooking chamber, and a controller configured to control the convection module. Here, the heat stage may comprise a first heat stage and a second heat stage that are sequentially performed, the cooking chamber may receive a cooking ingredient before the first heat stage, and the controller may control the convection module for each preset cycle in each of the first and second heat stages. In each cycle of the second heat stage, the controller may turn on the convection heater at the start time of each cycle, and control the turn-on and turn-off of the convection heater from a first time point that arrives after the start time of each cycle, based on a comparison result of a hysteresis curve having a predetermined target temperature as a set value with the sensed temperature.

The convection fan may be operated at a first RPM (revolutions per minute) or a second RPM lower than the first RPM, and the controller may operate the convection fan at the first RPM in entire time periods of the first and second heat stages.

Each cycle of the second heat stage comprises a first sub-cycle and a second sub-cycle, the controller may turn on the convection heater at a start time of the first sub-cycle, the controller may control the turn-on and turn-off of the convection heater based on the hysteresis curve in the second sub-cycle, and the first time point may correspond to the end time of the first sub-cycle and the start time of the second sub-cycle.

The duty ratio between the turn-on time and the turn-off time of the convection heater may be variable in the second sub-cycle.

The length of the first sub-cycle may be equal to that of the second sub-cycle.

The length of the cycle may be 60 seconds and the length of each of the first and second sub-cycles may be 30 seconds. The length of the time period in which the convection heater may be turned on in the first sub-cycle is 10 seconds.

The controller may turn on the convection heater and then turn off the convection heater in the first sub-cycle.

The controller may turn on the convection heater and then turn off the convection heater in each cycle of the first heat stage.

The length of the cycle is 60 seconds and the length of each of the time period in which the convection heater is turned on and the time period in which the convection heater is turned off may be 30 seconds.

The oven may further include at least one heating module configured to heat the cooking chamber. The controller may control the at least one heating module be turned off in the first and the second heat stage.

A method for controlling an oven in one embodiment, wherein the oven may includes a convection module, a sensor and a controller, and the controller may operate the oven in an air sous vide mode based on performing heat stage including a first heat stage and a second heat stage that are configured to be sequentially performed, may comprise receiving a cooking ingredient into a cooking chamber, performing the first heat stage, and performing the second heat stage. Here, in each of the first and second heat stages, the convection module may be controlled for each preset cycle. In each cycle of the second heat stage, the convection heater may be turned on at the start time of each cycle, and the convection heater may be controlled to turn-on and turn-off from a first time point that arrives after the start time of each cycle, based on a comparison result of a hysteresis curve having a predetermined target temperature as a set value with the sensed temperature.

The oven and the method for controlling thereof of one embodiment may heat cooking ingredient in the air sous vide mode.

Further, the oven and the method for controlling thereof of one embodiment may perform the air sous vide mode effectively by reducing the temperature deviation of the cooking chamber by using the hysteresis algorithm.

Still further, the oven and the method for controlling thereof of one embodiment may control the turning on/off of the convection heater using a hysteresis algorithm when the air sous vide mode is performed, thereby preventing malfunction of the oven and extending the life of the oven.

Specific effects are described along with the above-described effects in the section of detailed description.

BRIEF DESCRIPTION OF DRAWINGS

The accompanying drawings constitute a part of the specification, illustrate one or more embodiments in the disclosure, and together with the specification, explain the disclosure.

DETAILED DESCRIPTION

Figure 1:
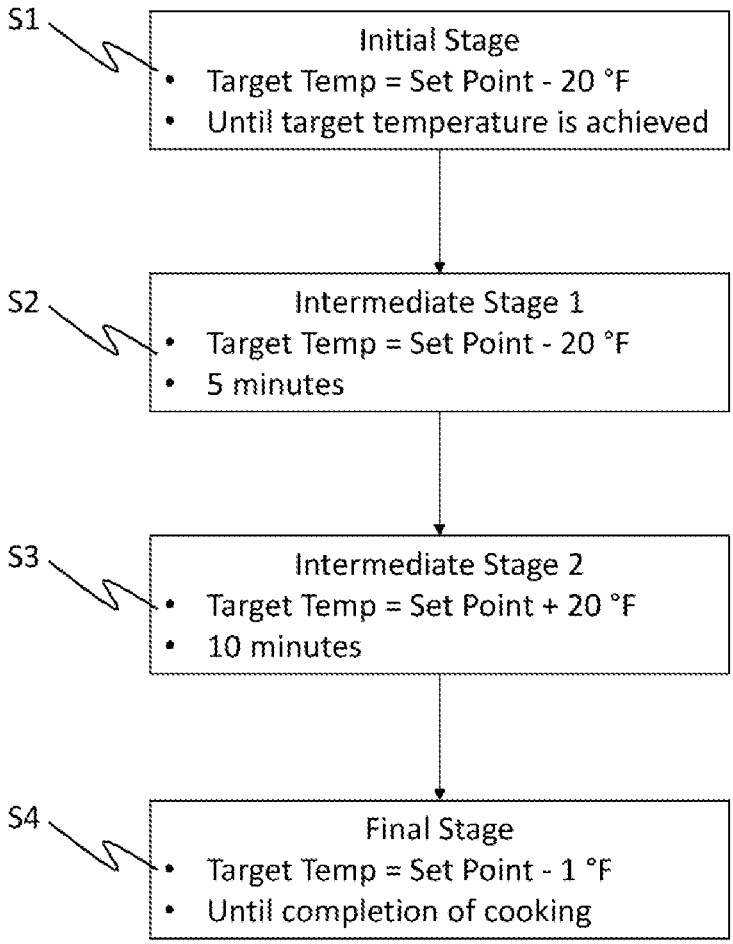
FIG. 1 Prior art
FIG. 1 is a diagram to describe the prior art applying an air sous vide method to an oven.

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Hereinafter, expressions of 'a component is provided or disposed in an upper or lower portion' may mean that the component is provided or disposed in contact with an upper surface or a lower surface. The present disclosure is not intended to limit that other elements are provided between the components and on the component or beneath the component.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Hereinafter, embodiments of the present disclosure will be described.

Figure 2:
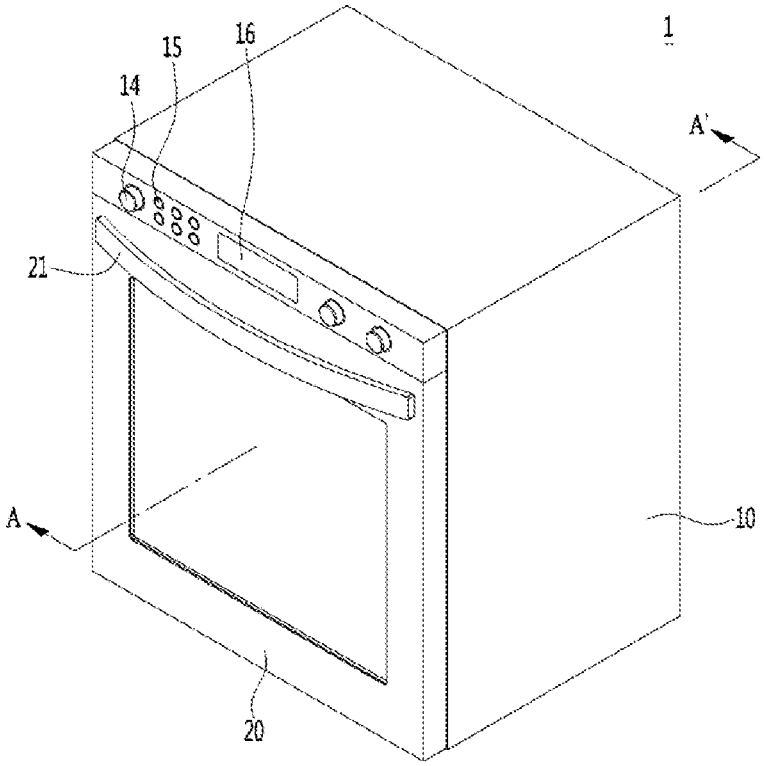
FIGS. 2 and 3 are perspective diagrams illustrating an oven in one embodiment.
Figure 3:
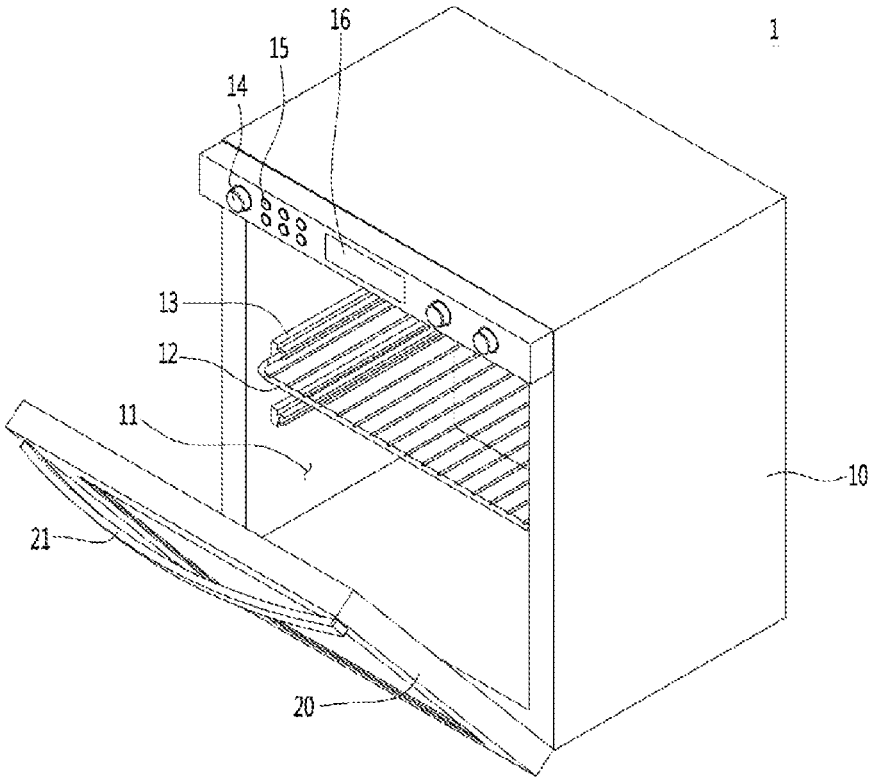
Figure 4:
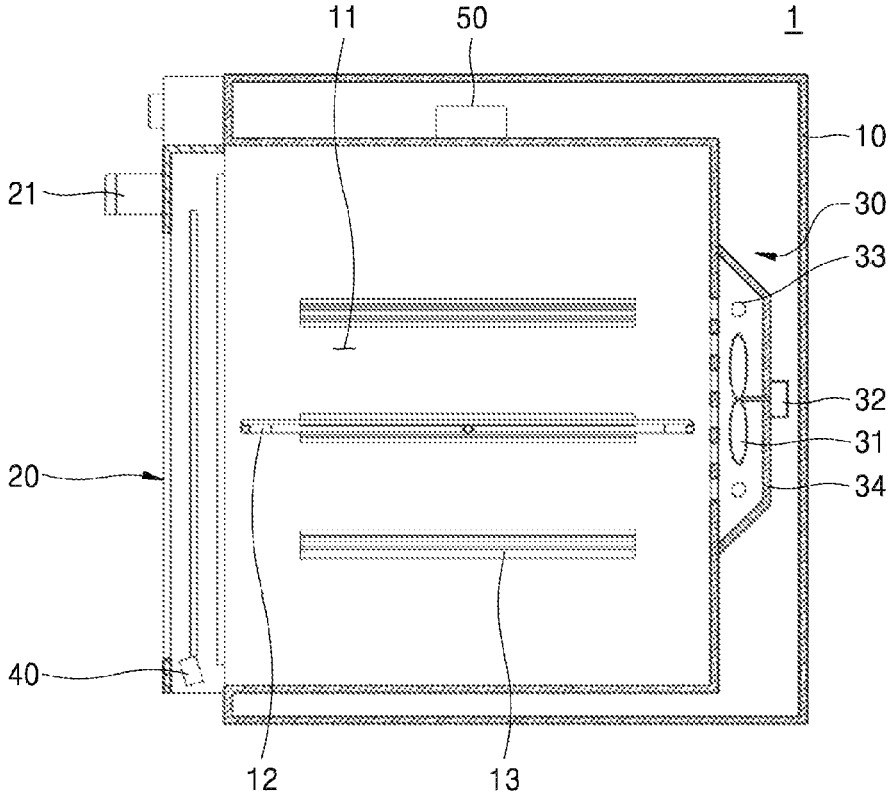
FIG. 4 is a sectional diagram of FIG. 2 along A-A'.

FIGS. 2 and 3 are perspective diagrams illustrating an oven according to one embodiment of the present disclosure. FIG. 4 is a sectional diagram of FIG. 2 along A-A'.

For convenience of description, the configuration of the oven 1 is schematically illustrated in FIGS. 2 to 4. FIG. 2 illustrates the oven 1 with a closed door and FIG. 3 illustrates the oven 1 with an open door.

Referring to FIGS. 2 to 4, the oven 1 according to one embodiment may include a case 10 defining an exterior design and a door 20 coupled to one side of the case 10.

The case 10 may be formed in a shape having an inner space and an open front. As one example, the case 10 may be formed in a predetermined box shape.

A cooking chamber 11 may be formed in the case 10 and a cooking ingredient may be cooked in the cooking chamber 11. A grill 12 may be provided in the cooking chamber 11 so that the cooking ingredient can be put on the grill. A grill mounting portion 13 may be provided in an inner side wall of the cooking chamber 11. The grill 12 may be detachably mounted to the grill mounting portion 13. The grill 12 and the grill mounting portion 13 may be provided in various numbers and shapes.

A plurality of heating sources may be installed inside the case 10 and outside the cooking chamber 11 to supply heat for cooking the cooking ingredient. The heating sources may include a convection module 30 and a boil heater 50.

The convection module 30 may provide high-temperature air, that is, hot air, to the cooking chamber 11. The provided high-temperature air may circulate in the cooking chamber 11, thereby generating convective heat in the cooking chamber 11.

The convection module 30 may include a convection fan 31, a convection motor 32 and a convection heater 33. The convection fan 31, the convection motor 32 and the convection heater 33 may be disposed in the convection module 30 defined by a convection cover 34 provided in one surface of the case 10.

The convection fan 31 may blow internal air of the cooking chamber 11. The convection motor 32 may provide a driving force for rotating the convection fan 31. The convection heater 33 may generate heat. The heat generated by the convection heater 33 may be supplied to the cooking chamber 11 through the convection fan 31.

In this instance, the convection fan 31 may operate at any one of the first revolutions per minute RPM and the second RPM. The first rotation number may be a RPM higher than a predetermined reference RPM and the second RPM may be a RPM lower than the reference RPM. Accordingly, the first RPM may be higher than the second RPM. "The operation of the convection fan 31 at the first RPM" (or the first RPM operation of the convection fan 31) may be corresponding to "the operation of the convection fan 31 at HI value". "The operation of the convection fan 31 at the second rotation" (or the HI value operation of the convection fan) may be corresponding to "the operation of the convection fan 31 at LO value" (or the LO value operation of the convection fan 31).

Meanwhile, in FIG. 4, the convection module 30 is provided in a rear surface of the case 10 corresponding to a backside of the cooking chamber 11, but the installation position of the convection module 30 is not limited thereto. As one example, the convection module 30 may be provide at least one of the rear surface or both lateral surfaces of the case 10 corresponding to the back side and side walls of the cooking chamber 11.

The broil heater 50 may be provided in an upper area of the cooking chamber 11 and configured to generate radiant heat supplied to the inside of the cooking chamber 11. The broil heater 50 may be any one of a carbon heater, a halogen heater, a ceramic heater and a sheath heater.

In general, the output of the broil heater 50 may be higher than that of the convection heater 33. As one example, the output of the broil heater 50 may be 4200 W and the output of the convection heater 33 may be 2500 W.

Rather than the convection module 30 and the broil heater 50, other various heating sources may be further provided. As one example, such heating sources may include a magnetron. The magnetron may be a high-frequency heating source that oscillates microwaves into the cooking chamber 11.

A power supply unit 14, an input unit 15 and a display 16 may be provided in an outer surface of the case 10.

The power supply unit 14 may be provided in various shapes capable of allowing the user to turn on and off the power of the oven 1.

The input unit 15 may be provided as a plurality of buttons so that the user can select various driving modes, set temperatures, driving times and the like. In this instance, the set temperature is the temperature set by the user to cook the cooking ingredient.

The display 16 may be configured to display predetermined information that allows the user to determine a current state of the oven 1.

The door 20 may be coupled to the open front surface of the case 10 and configured to open and close the cooking chamber 11. Specifically, the cooking chamber 11 may be open and closed by the door 20. For convenience of description, the configuration related to the installation structure and the locking mechanism of the door 20 may be omitted.

As shown in FIG. 3, the door 20 may be rotatable on the front surface of the case 10. In addition, the door 20 may include handle 21 that may be grabbed and rotated by the user.

Meanwhile, although not shown in FIGS. 2 to 4, a temperature sensor (not shown) may be further provided in the cooking chamber 11. The temperature sensor may measure the internal temperature of the cooking chamber 11, that is, the internal temperature. The measured internal temperature may be transmitted to a controller which will be described later. As one example, the temperature sensor may be a thermostat.

Meanwhile, the oven shown in FIGS. 2 to 4 may be exemplary, and components may be omitted or added.

Figure 5:
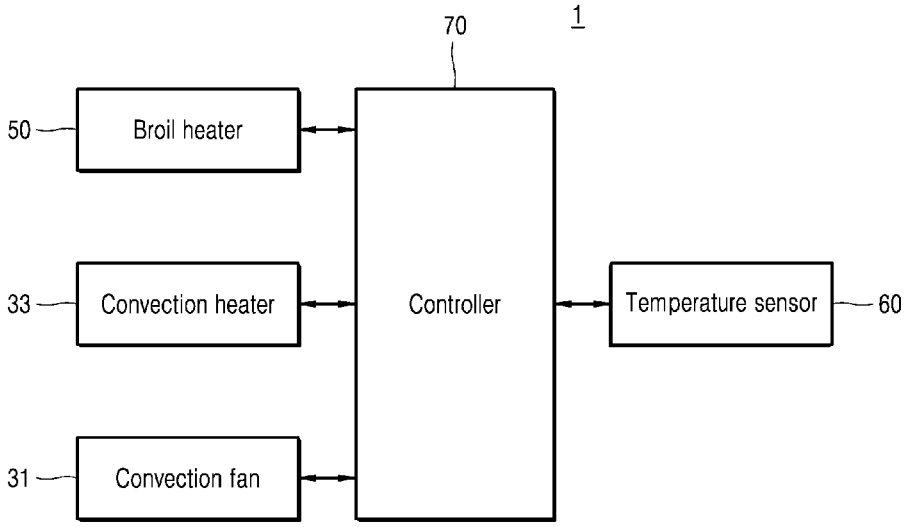
FIG. 5 is a diagram illustrating a control configuration of an oven in one embodiment.

FIG. 5 is a diagram illustrating a control configuration of the oven 1 according to one embodiment.

Referring to FIG. 5, the oven 1 may include a controller 70.

The controller 70 may be a processor-based device. Here, the processor may include one or more of a central processing unit, an application processor and a communication processor. The processor may execute calculations or data processing related to control and/or communication of at least one other component provided in the oven 1. As one example, the controller 70 may be a microcomputer.

The controller 70 may control the driving of the convection fan 31, the convection heater 33 and the broil heater 50. Meanwhile, the convection fan 31 may be driven by the convection motor 32, and "the control of the convection fan 31" should be understood as the same meaning as "the control of the convection motor 32".

The controller 70 may receive internal temperatures of the cooking chamber 11 from the temperature sensor 70. The controller 70 may compare the preset temperature for the cooking ingredient input by the user with the internal temperature, and control the driving of the convection fan 31, the convection heater 33 and the broil heater 50 based on the result of the comparison. As one example, the controller 70 may control the driving of the convection fan 31, the convection heater 33 and the broil heater 50 for the internal temperature of the cooking chamber to reach the preset temperature.

Meanwhile, the user may cook the cooking ingredient in various operation modes. Especially, the operation modes may include an air sous vide mode. The air sous vide mode is a cooking mode configured to slowly heat the cooking ingredient at an accurately calculated temperature through air, without using water or a bag.

Hereinafter, referring to FIGS. 6 through 8, the operation of the oven 1 for performing the air sous vide mode will be described in detail.

Figure 6:
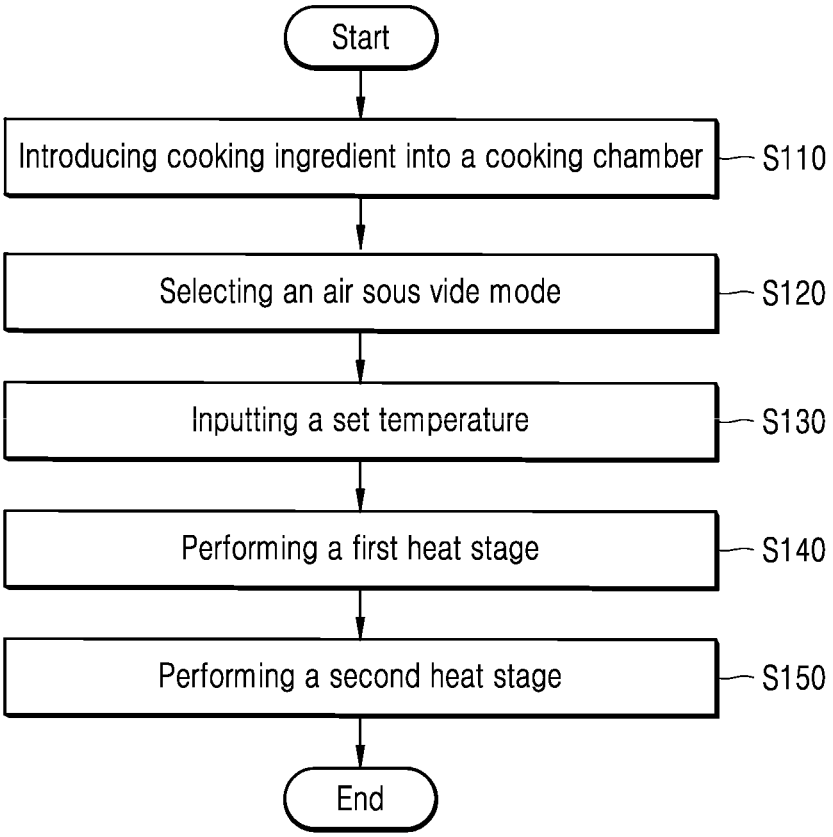
FIG. 6 is a flow chart illustrating a method for controlling the oven in one embodiment.

FIG. 6 is a flow chart illustrating a method for controlling the oven according to one embodiment. FIG. 7 is a diagram illustrating the temperature of the cooking chamber 11, the timing of the convection heater 33 and the convection fan 31.

The control method shown in FIG. 6 may be corresponding to the operation of the oven configured to perform the air sous vide mode. When performing the air sous vide mode, only the convection module 30 may operates and other heating sources than the convection module 30 (e.g., the broil heater 50, the magnetron, etc.) may not operate. As mentioned above, the convection heater 33 and the convection fan 31 may be driven under the control of the controller 70.

Hereinafter, specific steps performed in each step will be described in detail.

In a step S110, the cooking ingredient may be received in the cooking chamber 11.

Specifically, the cooking ingredient may be disposed on a top of a grill 12 provided in the cooking chamber 11.

In a step S120, the user may input the air sous vide mode through the input unit 15.

In a step S130, the user may input a preset temperature through the input unit 15.

The set temperature means the temperature required to cook the cooking ingredient. Generally, the set temperature may be equal to a target temperature of the cooking chamber 11. The set temperature may be variable according to the type of the cooking ingredient. In this instance, the cooking ingredient may include meat such as steak and chicken breast, fish such as salmon, and vegetables such as asparagus.

In a step S140, a first heat stage may be performed. In a step S150, a second heat stage may be performed. In other words, the oven 1 may sequentially perform the first heat stage and the second heat stage in the air sous vide mode.

The first heat stage and the second heat stage may be cooking processes. Especially, since cooking ingredient may be received into the cooking chamber 11 before the first heat stage, the first heat stage may be a cooking process, not a preheating process. Accordingly, when performing the air sous vide mode, the oven 1 may not perform the preheating operation.

In each of the first heat stage and the second heat stage, the convection module 30 may be driven for each cycle having a preset time section. A cycle may have various time periods. As one example, the time period may be 60 seconds and the present disclosure is not limited thereto.

Figure 7:
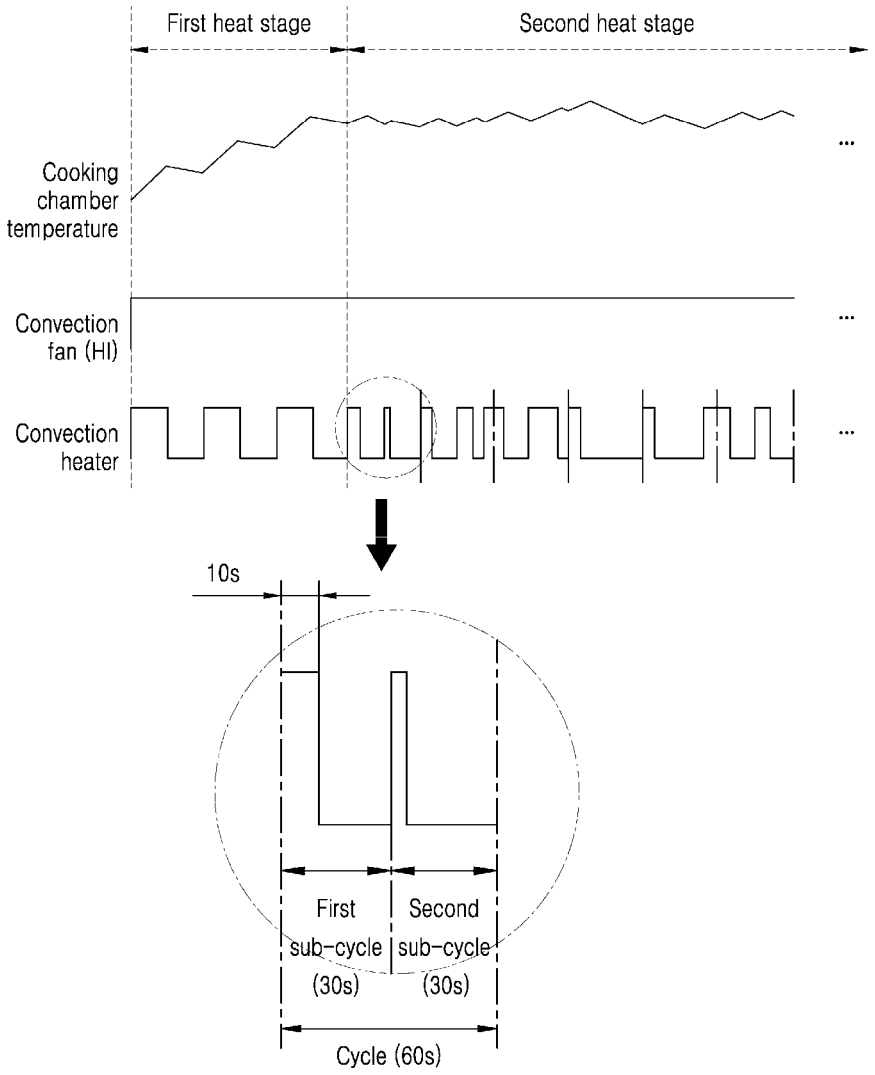
FIG. 7 is a diagram illustrating a temperature of a cooking chamber, a timing of a convection heater and a convection fan in one embodiment.

Referring to FIG. 7, in the first heat stage, the convection heater 33 may periodically repeat turn-on and turn-off. Specifically, during the cycle of the first heat stage, the controller 70 may turn on the convection heater 33 and turn off the convection heater 33 after that. Here, the length of the time period in which the convection heater 33 is turned on may be the same as the length of the time period in which the convection heater 33 is turned off. As one example, when the length of the cycle is 60 seconds, the convection heater 33 may be turned on for 30 seconds and then turned off for 30 seconds.

In the entire time periods of the first heat stage, the convection fan 31 may always be turned on at a fixed RPM. As one example, the convection fan 31 may be operated (i.e., turned on) at a first RPM. Accordingly, cooking ingredient may be quickly heated in the first heat stage.

Referring to FIG. 7, in the second heat stage, the convection heater 33 may be turned on and turned off based on the set temperature (i.e., the target temperature). In the entire time periods of the second heat stage, the convection fan 31 may be operated at the same RPM as that of the first heat stage (e.g., the first RPM). Accordingly, the internal temperature of the cooking chamber may be maintained within a certain range.

Figure 8:
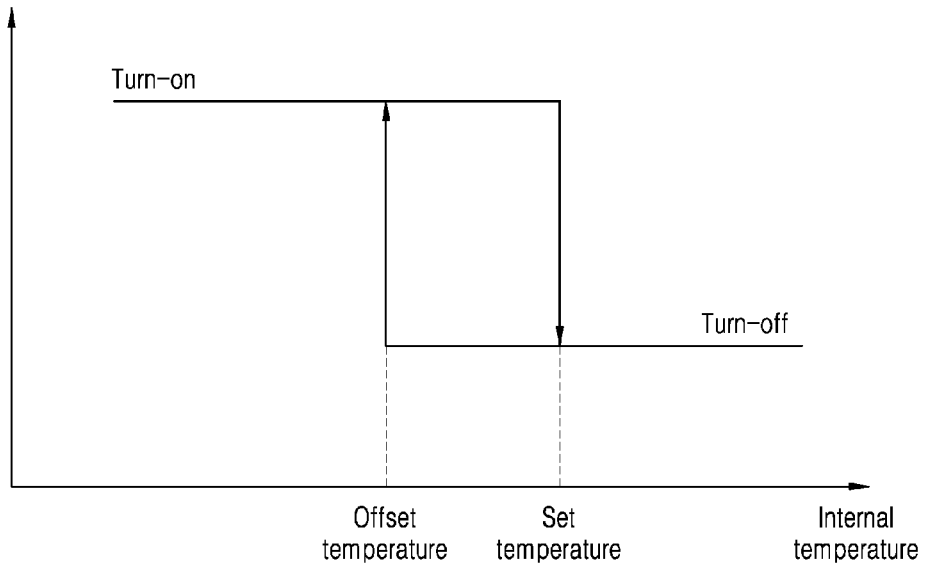
FIG. 8 is a graph of a hysteresis curve used in a hysteresis algorithm applied to the present disclosure.

Referring to FIG. 8, the second heat stage will be described in detail.

In the second heat stage, each cycle may include a first sub-cycle and a second sub-cycle. The first sub-cycle and the second sub-cycle may have a fixed length. In particular, the length of the first sub-cycle and the length of the second sub-cycle may be the same. As one example, when the length of the cycle is 60 seconds, the length of the first sub-cycle and the length of the second sub-cycle may be 30 seconds, respectively.

However, the present disclosure is not limited thereto and each of the first sub-cycle and the second sub-cycle may have various lengths. As one example, when the length of the cycle is 60 seconds, the length of the first sub-cycle may be 20 seconds and the length of the second sub-cycle may be 20 seconds.

At the start time of the first sub-cycle, the controller may turn on the convection heater 33. That is, the controller 70 may turn on the convection heater 33 for a preset time at the start time of each cycle of the second heat stage.

In addition, in the first sub-cycle, the controller 70 may turn on the convection heater 33 for a preset time period and turn off the convection heater 33 for the other time period. That is, in the first sub-cycle, the convection heater 33 may be turned on and then turned off, and turned off at the end time of the first sub-cycle.

As one example, when the length of the cycle is 60 seconds and the length of the first-sub cycle is 30 seconds, the length of the time period in which the convection heater 33 is turned in the first sub-cycle may be 10 seconds but the present disclosure may not be limited thereto.

In the second sub-cycle after the first sub-cycle, the controller may control the turn-on and the turn-off of the convection heater 33 based on a hysteresis algorithm.

Specifically, the controller 70 may control the turn-on and turn-off of the convection heater 33 based on the hysteresis algorithm from a first time point that arrives after the start time of each cycle. Here, the first time point may be a time point corresponding to the end time of the first sub-cycle and the start time of the second sub-cycle, and may be an intermediate point between the start time of the cycle and the end time of the cycle.

In other words, the first sub-cycle may be a control time period of the convection heater 33 within a cycle that is not based on the hysteresis algorithm. The second sub-cycle may be a control time period of the convection heater 33 within the cycle that is based on the hysteresis algorithm.

FIG. 8 is a graph of a hysteresis curve used in a hysteresis algorithm applied to the present disclosure.

The hysteresis algorithm may be a feedback type control algorithm, and control the temperature of a target object by comparing a hysteresis curve having a target temperature as a set value with the temperature of the target object sensed by the temperature sensor.

FIG. 8 shows the hysteresis curve for controlling the heating of the cooking chamber 11. Referring to FIG. 8, the controller 70 may compare the internal temperature sensed by the temperature sensor provided in the cooking chamber with the set temperature (i.e., the target temperature) input in the step S120, and control the turn-on and turn-off of the convection heater 33 based on the result of the comparison. The temperature of the cooking chamber 11 controlled based on the hysteresis algorithm is shown in FIG. 7.

Referring to FIGS. 7 and 8, when the convection heater 33 is turned, the internal temperature rises. When the internal temperature reaches the set temperature, the convection heater 33 may be turned off. In this instance, after the internal temperature partially rises due to the latent heat of the convection heater 33, the internal temperature may continuously falls.

When the internal temperature reaches an offset temperature that is lower than the set temperature, the convection heater 33 may be turned on. In this instance, the internal temperature of the cooking chamber may continuously be raised by the driving of the convection heater 33.

Meanwhile, since the turn-on and turn-off of the convection heater 33 may be controlled based on the internal temperature of the cooking chamber, the duty ratio between the turn-on time and the turn-off time of the convection heater 33 may be changed in the second sub-cycle. In other words, the duty ratios for respective second sub-cycles may be the same or different from each other.

In brief, the convection heater 33 may be turned on and off based on the result of comparison between the hysteresis curve and the sensed temperature. The offset temperature of the hysteresis curve may be properly set, thereby the oven 1 maintaining the internal temperature within a preset temperature range.

Table 1 below is a table summarizing examples of the temperature of the cooking chamber 11 according to the method for controlling the oven described above.

TABLE 1

| Set temperature | Internal temperature | |
|---|---|---|
| 54° C. | Min. | 54.7° C. |
| | Max. | 58.9° C. |
| | Avg. | 56.8° C. |
| 64° C. | Min. | 64.3° C. |
| | Max. | 68.7° C. |
| | Avg. | 66.6° C. |
| 77° C. | Min. | 76.6° C. |
| | Max. | 78.5° C. |
| | Avg. | 77.8° C. |
| 96° C. | Min. | 94.2° C. |
| | Max. | 98.5° C. |
| | Avg. | 96.3° C. |

Referring to Table 1, the oven 1 according to the present disclosure may set the deviation of the minimum and maximum internal temperature within ±5° C. in the air sous vide mode. Accordingly, the oven 1 according to the present disclosure may effectively realize the air sous vide cooking method.

In summary, to implement the air sous vide mode, the oven 1 according to one embodiment may turn on the convection heater 33 for a predetermined time in an initial time period of each cycle and turn off the convection heater 33 after that. Hence, the oven 1 may control the turn-on and turn-off of the convection heater 33 from the first time point of the cycle based on the hysteresis algorithm. In other words the oven 1 according to one embodiment may use the hysteresis algorithm only in a part of each cycle of the second heat stage, not using the entire part of each cycle of the second heat stage. Accordingly, the product life of the oven 1 may be guaranteed.

More specifically, the convection heater 33 may be changed in a driving state (i.e., turned on and off) through a relay, that is, a switch. The relay may have a critical number of operations (i.e., a lifespan). If the critical number of operations is exceeded, the relay will not operate, and the oven 1 may not operate accordingly.

Here, if the convection heater 33 is frequently turned on and off to precisely maintain the internal temperature, the lifespan of the relay may be shortened. According to the present disclosure, the lifespan of the relay may be guaranteed by using the hysteresis algorithm from the first time point of each cycle of the second heat stage, thereby preventing the failure of the oven 1.

Furthermore, the oven may use the hysteresis algorithm so that it may be possible to prevent excessive repetition of turning on/off of the convection heater 33 when the internal temperature of the cooking chamber 11 is maintained. Accordingly, the failure of the oven 1 may be further prevented. Since using the hysteresis algorithm, the oven 1 may quickly heat the cooking ingredient in the sous vide method and reduce the temperature deviation of the cooking chamber 11 at the same time.

Even though all components constituting the embodiment of the present disclosure are described as being combined to operate as one, the present disclosure may not be necessarily limited to this embodiment, but all components within the scope of the present disclosure may operate by selectively combining one or more. In addition, all of the components may be implemented as one independent hardware, but some or all of the components may be selectively combined and implemented as a computer program having a program module configured to perform some or all functions combined in one or a plurality of hardware. Codes and code segments of the computer program may be easily derived by those skilled in the art to which the present disclosure pertains. Such the computer program may be stored in a computer-readable storage medium (i.e., Computer Readable Media) read and executed by the computer, thereby implementing the embodiments of the present disclosure. The storage medium of the computer program may include a magnetic recording medium, an optical recording medium and a storage medium including a semiconductor recording device.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. An oven comprising:

a case that defines a cooking chamber;

a sensor configured to sense a temperature of the cooking chamber;

a convection module comprising a convection heater configured to heat air and a convection fan configured to supply the air heated by the convection heater into the cooking chamber; and a controller configured to control the convection module, wherein the controller is configured to operate the oven in an air sous vide mode based on performing a plurality of heat stages, the plurality of heat stages comprising (i) a first heat stage configured to be performed after a cooking ingredient being received in the cooking chamber and (ii) a second heat stage configured to be performed after the first heat stage, wherein the controller is configured to:

start the second heat stage at an end time point of the first heat stage, in each of the first and second heat stages, control the convection module in a plurality of cycles, turn on the convection heater at a start time of each cycle of the plurality of cycles of the second heat stage, and after turning on the convection heater at the start time of each cycle of the plurality of cycles of the second heat stage, control the convection heater to turn off and turn on based on comparing the temperature of the cooking chamber sensed by the sensor to a predetermined target temperature that is set in a hysteresis curve of the temperature of the cooking chamber.

2. An oven comprising:

a case that defines a cooking chamber;

a sensor configured to sense a temperature of the cooking chamber;

a convection module comprising a convection heater configured to heat air and a convection fan configured to supply the air heated by the convection heater into the cooking chamber; and a controller configured to control the convection module, wherein the controller is configured to operate the oven in an air sous vide mode based on performing a plurality of heat stages, the plurality of heat stages comprising (i) a first heat stage configured to be performed after a cooking ingredient being received in the cooking chamber and (ii) a second heat stage configured to be performed after the first heat stage, wherein the controller is configured to:

in each of the first and second heat stages, control the convection module in a plurality of cycles, turn on the convection heater at a start time of each cycle of the plurality of cycles of the second heat stage, and after turning on the convection heater at the start time of each cycle of the plurality of cycles of the second heat stage, control the convection heater to turn off and turn on based on comparing the temperature of the cooking chamber sensed by the sensor to a predetermined target temperature that is set in a hysteresis curve of the temperature of the cooking chamber, wherein the convection fan is configured to operate at a first revolutions per minute (RPM) and a second RPM that is less than the first RPM, and wherein the controller is configured to operate the convection fan at the first RPM for entire time periods of the first and second heat stages.

3. The oven of claim 1, wherein each cycle of the plurality of cycles of the second heat stage comprises a first sub-cycle and a second sub-cycle, the second sub-cycle being configured to be performed after the first sub-cycle, and wherein the controller is configured to:

turn on the convection heater at a start time of the first sub-cycle, and in the second sub-cycle after an end time of the first sub-cycle, control the convection heater to turn off and turn on based on comparing the temperature of the cooking chamber sensed by the sensor to one or more set temperatures in the hysteresis curve, the end time of the first sub-cycle corresponding to a start time of the second sub-cycle.

4. The oven of claim 3, wherein the controller is configured to vary a duty ratio between a turn-on duration and a turn-off duration of the convection heater in the second sub-cycle.

5. The oven of claim 3, wherein the controller is configured to:

in the second sub-cycle, turn off the convection heater based on the temperature of the cooking chamber sensed by the sensor corresponding to the predetermined target temperature that is set in the hysteresis curve; and after turning off the convection heater in the second sub-cycle, turn on the convection heater based on the temperature of the cooking chamber sensed by the sensor corresponding to an offset temperature that is set in the hysteresis curve, the offset temperature being less than the predetermined target temperature.

6. The oven of claim 3, wherein a duration of the first sub-cycle is equal to a duration of the second sub-cycle.

7. The oven of claim 3, wherein a duration of each of the first and second sub-cycles is 30 seconds such that a duration of each cycle of the plurality of cycles of the second heat stage is 60 seconds, and wherein the controller is configured to turn on the convection heater for 10 seconds in the first sub-cycle.

8. The oven of claim 3, wherein the controller is configured to turn on the convection heater and then turn off the convection heater in the first sub-cycle.

9. The oven of claim 1, wherein the controller is configured to turn on the convection heater and then turn off the convection heater in each cycle of the plurality of cycles of the first heat stage.

10. The oven of claim 9, wherein a duration of each cycle of the plurality of cycles of the first heat stage is 60 seconds, and wherein the controller is configured to turn on the convection heater for 30 seconds and then turn off the convection heater for 30 seconds in each cycle of the plurality of cycles of the first heat stage.

11. The oven of claim 1, further comprising at least one heating module configured to heat the cooking chamber, wherein the controller is configured to turn off the at least one heating module while performing the first and the second heat stages.

12. A method for controlling an oven having a cooking chamber, the oven including a sensor configured to sense a temperature of the cooking chamber, a convection module including a convection heater configured to heat air and a convection fan configured to supply the air heated by the convection heater into the cooking chamber, and a controller configured to control the convection module, the controller being configured to operate the oven in an air sous vide mode based on performing a plurality of heat stages including a first heat stage and a second heat stage, the method comprising:

receiving a cooking ingredient into the cooking chamber before performing the first heat stage;

performing the first heat stage in a plurality of cycles; and performing the second heat stage in a plurality of cycles after performing the first heat stage, wherein performing the second heat stage comprises:

starting the second heat stage at an end time point of the first heat stage, turning on the convection heater at a start time of each cycle of the plurality of cycles of the second heat stage, and after turning on the convection heater at the start time of each cycle of the plurality of cycles of the second heat stage, controlling the convection heater to turn off and turn on based on comparing the temperature of the cooking chamber sensed by the sensor to a predetermined target temperature that is set in a hysteresis curve of the temperature of the cooking chamber.

13. The method of claim 12, wherein each cycle of the plurality of cycles of the second heat stage comprises a first sub-cycle and a second sub-cycle, the second sub-cycle being configured to be performed after the first sub-cycle, and wherein controlling the convection heater comprises turning off and turning on the convection heater after an end time of the first sub-cycle, the end time of the first sub-cycle corresponding to a start time of the second sub-cycle.

14. The method of claim 12, wherein the convection fan is configured to operate at a first revolutions per minute (RPM) and a second RPM that is less than the first RPM, and wherein the method further comprises operating the convection fan at the first RPM for entire time periods of the first and second heat stages.

15. The method of claim 12, wherein each cycle of the plurality of cycles of the second heat stage comprises a first sub-cycle and a second sub-cycle, the second sub-cycle being configured to be performed after the first sub-cycle, and wherein performing the second heat stage comprises:

turning on the convection heater at a start time of the first sub-cycle, and in the second sub-cycle after an end time of the first sub-cycle, controlling the convection heater to turn off and turn on based on comparing the temperature of the cooking chamber sensed by the sensor to one or more set temperatures in the hysteresis curve.

16. The method of claim 15, further comprising:

varying a duty ratio between a turn-on duration and a turn-off duration of the convection heater in the second sub-cycle.

17. The method of claim 15, wherein controlling the convection heater comprises:

in the second sub-cycle, turning off the convection heater based on the temperature of the cooking chamber sensed by the sensor corresponding to the predetermined target temperature that is set in the hysteresis curve; and after turning off the convection heater in the second sub-cycle, turning on the convection heater based on the temperature of the cooking chamber sensed by the sensor corresponding to an offset temperature that is set in the hysteresis curve, the offset temperature being less than the predetermined target temperature.

18. The method of claim 15, wherein a duration of each of the first and second sub-cycles is 30 seconds such that a duration of each cycle of the plurality of cycles of the second heat stage is 60 seconds, and wherein the convection heater is turned on for 10 seconds in the first sub-cycle.

19. The method of claim 12, further comprising:

maintaining a duty ratio between a turn-on duration and a turn-off duration of the convection heater in each cycle of the plurality of cycles of the first heat stage.

20. The method of claim 12, wherein a duration of each cycle of the plurality of cycles of the first heat stage is 60 seconds, and wherein performing the first heat stage comprising turning on the convection heater for 30 seconds and then turning off the convection heater for 30 seconds in each cycle of the plurality of cycles of the first heat stage.

* * * * *